US011337502B2

(12) United States Patent
Lilly, Jr.

(10) Patent No.: US 11,337,502 B2
(45) Date of Patent: May 24, 2022

(54) EDGE ANGEL EYEBROW GUIDE AND HAIRCUTTING TEMPLATE STENCIL DEVICE

(71) Applicant: Linton Lilly, Jr., Greenacres, FL (US)

(72) Inventor: Linton Lilly, Jr., Greenacres, FL (US)

( * ) Notice: Subject to any disclaimer, the term of this patent is extended or adjusted under 35 U.S.C. 154(b) by 341 days.

(21) Appl. No.: 16/517,538

(22) Filed: Jul. 20, 2019

(65) Prior Publication Data

US 2021/0015235 A1 Jan. 21, 2021

(51) Int. Cl.
*A45D 24/36* (2006.01)
*A45D 40/30* (2006.01)

(52) U.S. Cl.
CPC ..... *A45D 24/36* (2013.01); *A45D 40/30* (2013.01)

(58) Field of Classification Search
CPC ..... A45D 24/36; A45D 40/30; A45D 27/42
USPC ..... 132/213, 213.1, 214, 216; D28/44.2
See application file for complete search history.

(56) References Cited

U.S. PATENT DOCUMENTS 2,435,516 A * 2/1948 Samson ..... A45D 40/30 132/216
5,186,190 A * 2/1993 Hirzel ..... A45D 40/30 132/216
D634,893 S * 3/2011 Brown ..... D28/44.2
D768,332 S * 10/2016 Esnard ..... A45D 40/30 D28/44.2
D814,113 S * 3/2018 Yeheskel ..... A45D 24/36 D28/44.2
2008/0276953 A1* 11/2008 McGee ..... A45D 40/30 132/201
2009/0223530 A1* 9/2009 Chapman ..... A45D 27/42 132/200
2013/0213429 A1* 8/2013 Allen ..... A45D 24/36 132/214
2019/0125060 A1* 5/2019 Dang ..... A45D 40/30

OTHER PUBLICATIONS

YouTube video titled "Cut Buddy Plus (2.0) & Free Promo Code NEW!" by Andre' ClassicCuts published May 18, 2019 and available at https://www.youtube.com/watch?v=eb0t8LFVaDI. (Year: 2019).*

* cited by examiner

*Primary Examiner* — Amy R Weisberg

(57) ABSTRACT

A multifunctional grooming template and stencil designed to be an all-in-one tool used to assist the user in cutting, trimming, shaping and drawing of the eyebrows, hairline, mustache, sideburns, beard and goatee facial patterns provided on the template. The design allows for simplistic shaping of each facial feature by allowing minimal adjustments for each section while the template is overlaid on the face and head. Straps are adjustable, elastic and removable so they can be removed at the user's discretion and fit all size heads and faces in various orientations. This feature enables hands free options. Slots are placed so that the invention can be mounted to the face and head in various orientations using the straps. A wide variety of shapes and curves comprise the template to maximize grooming by allowing the user to fill in, trim or cut the pattern of their choice with ease and consistency.

1 Claim, 2 Drawing Sheets

EDGE ANGEL EYEBROW GUIDE AND HAIRCUTTING TEMPLATE STENCIL DEVICE

CROSS REFERENCE TO RELATED APPLICATION

This patent is related to U.S. Provisional patent application Ser. No. 12/397,576 filed Mar. 4, 2009.

TECHNICAL FIELD OF INVENTION

This invention relates to patent D768,332 S for a hair grooming guide. This invention also relates to an eyebrow stencil. Particularly for cutting and shaping facial hair and hairline in addition to the styling, shaping and upkeep of eyebrows. This invention differs from other previous inventions in that it combines features of a hairline & facial grooming guide template with the features of an eyebrow stencil all in one tool. In addition, it incorporates multiple removable, adjustable, elastics straps in combination with well placed slots in the template to allow for it to be affixed to any sized head at multiple angles and locations. This allows for more accurate shaping and provides hands free features so the user has more control over what they are doing and does not ruin their hair while worrying about holding the template in place with one hand and a grooming tool with the other hand.

BACKGROUND OF INVENTION

Prior to this invention, it was common practice for men and women to either cut, shave and trim their facial hair and hairline area or have it done for them in order to maintain a well-groomed, attractive, and professional everyday look. Unfortunately, work, responsibilities and a busy schedule will not always permit for timely visits to the barbershop or salon. Oftentimes a trip to the barbershop or salon can develop into a timely journey resulting in a person to wait amongst others with similar goals. Occasionally, this process becomes too cumbersome and people are forced to take matters into their own hands by attempting to groom and shape themselves up. As ambitious as people are, many attempt and fail at grooming themselves after realizing the amount of skill required to maintain a steady hand and coordinate the movements required to trim and groom one's face, hairline and eyebrows for a clean, crisp, consistent and symmetrical look. Resulting in them living with their mistake for some time.

Women go through a similar hardship despite wanting to maintain a hairless lifestyle. The need for eyebrows will never cease to exist. Many seek professional help in this field but over time this option can be costly and time consuming as well. As a result, most people put the challenge of maintaining and grooming their eyebrows into their own hands. Whether it be grooming periodically, every morning or just before occasions; just finding the time to get it down can seem impossible. Not to mention it can become troublesome over time especially trying to maintain a consistent, clean and symmetrical look. Making consistent and symmetrical eyebrow designs may be simple for experts but to reproduce the same results without being left with unwanted facial expressions can become tiresome and difficult for the common user.

This invention was created with the purpose of empowering both men and women with the ability, confidence and freedom to groom, trim and shape their hairline, facial hair area and eyebrows with a consistent, clean and symmetrical design of their choice in a timely and cost efficient manner.

SUMMARY OF INVENTION

Users consistently face the predicament of maintaining their appearance on a daily basis. This task can become problematic due to their lack of skill in performing such a duty on their own. As a result, users are forced to seek a professional at a barbershop or salon to shape up their hairline and eyebrows. Users are forced to cater to these professionals both in their time and money in order to maintain their look on a consistent basis.

The premise of this invention is to empower the user with the ability to shape, trim, color and sketch their hairline, facial hair and eyebrows without the assistance of a professional. Giving the user the freedom and ability to look their best without having to wait all while in the convenience of their home. Ultimately, allowing them to save a tremendous amount of time and money. Personally, I use it in between cuts to maintain a well groomed appearance or for emergency situations when time constraints restrict me from seeing a barber in time. With proper mastery this invention can replace the need of a barber.

Unlike other similar inventions on the market, this invention differs since it combines the features of a guide and template for trimming or cutting of the hairline or facial hair area with a stencil designed to aid the user in trimming, tracing or coloring of the eyebrow. Due to the fixed shape, the user will be able to choose the facial design of their choice and produce symmetrical and consistent looks. This also allows for versatility and ease for the user because they can utilize one tool to accomplish multiple tasks. The combination of the elastic, adjustable, removable band with the flexible body of the invention allows the user to overlay and mount the invention to one's face so that consistent designs can be maintained without the device shifting. This feature empowers the user with hands free options so they can use their hands freely and are not obligated to hold the invention up to their face or head. This elastic band also allows the invention to fit on any size head or face effortlessly. Factoring in the one-time price of the invention, the user will easily save money when comparing the cost of going to a barbershop or salon to get one's hair and eyebrows done.

This invention allows for both men and women to sketch, trim or color in a consistent and acceptable eyebrow & hairline designs of their choosing. Since the invention combines the features of an eyebrow stencil and a hair cutting guide with mounting and measuring capabilities at the mere price of a single haircut this template and stencil device far exceeds the capabilities of previous inventions used for grooming and shaping of the face and head and will pay for itself time and time again.

BRIEF DESCRIPTION OF THE DRAWINGS

The following figures show the shape, features and components of the invention. The figures break down the intended use of each section of the invention.

FIG. 2 through FIG. 6 illustrates various orientations in which the invention can be used but are not limited to these alone. In order to achieve best results, these orientations should be performed with the aid of the strap assembly shown in FIG. 1 consisting of components (5) hook, (6) strap, (10) zipper pull, and (11) cord lock meant to be affixed to the various slots on the invention so that the user can properly mount the invention to their face allowing them to use both hands freely as opposed to being restricted to using one hand to hold the invention up.

DETAILED DESCRIPTION

Figure 1:
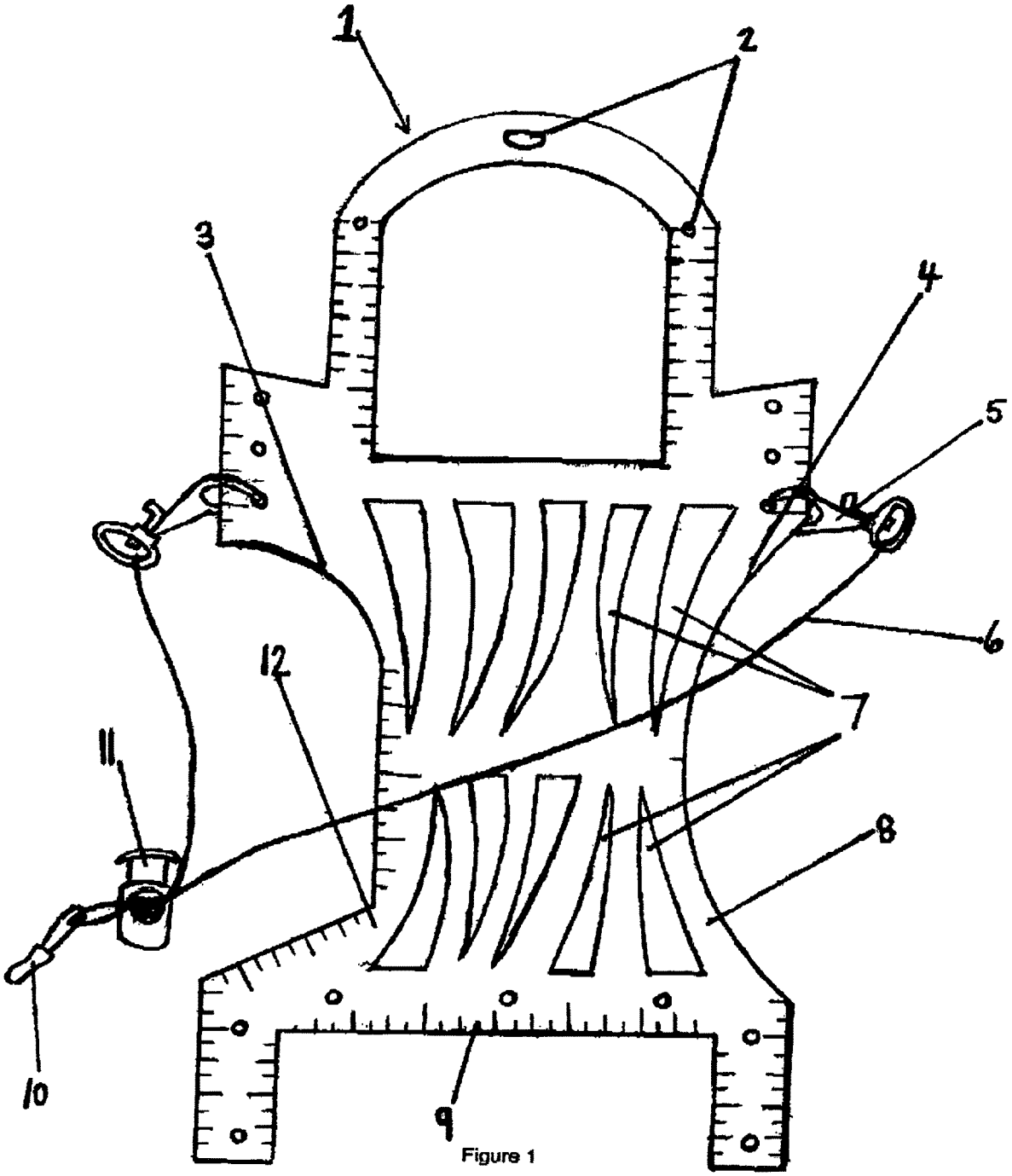
FIG. 1 shows a front view of the invention which is an assembly that consists of the hair guide and stencil device in addition to straps designated to mount the template to the user's discretion. The invention is designed to be overlaid on the face in order to help the user modify their hairline, facial hair and eyebrows to the design of their choice.

In FIG. 1, Point 1 shows a picture of what the invention looks like which is an assembly that consists of a hair guide and stencil template in addition to straps. The holes allow the invention to be flipped or rotated to perform various tasks while producing various looks. The body is made of a transparent plastic with measurements on it so that the user can see through the template when they lay it on their face to create precise and consistent looks during their grooming process. Due to the material properties, the template is designed to be transparent, flexible, water resistant, strong and durable so that the user can bend, manipulate, overlay and affix it to their face to accomplish their desired grooming goals. Initially, the body of the invention was designed using an electronic modeling program and then 3D printed but more cost efficient processes can be utilized to manufacture it quicker and cheaper by using the electronic model as a guide to cut it out from sheets to the desired form. The manufacturing processes that can be used to create this invention include a mold, milling and cutting by waterjet or laser being the most robust option. The invention also provides options for the user to mount or affix it to the face for more simple and steady handling for crisp and consistent looks.

Point 2 in FIG. 1 indicates a few of the various slots along the template that allow it to be mounted in various orientations to the user's face and head at their own discretion.

Point 3 in FIG. 1 indicates the curve along the left side of the template designated to be used to align the top to the bottom section of the sideburns in one of many shapes.

Point 4 in FIG. 1 indicates the curve along the right side of the template designated to be an additional shape to be used to align the top to the bottom section of the sideburns in a different manner.

Point 5 in FIG. 1 indicates a hook which is a part of the strap assembly. This hook can be positioned in slots so that the user can adjust and mount the template to sections of the head and face to accomplish their desired needs.

Point 6 in FIG. 1 indicates the flexible band used to allow the strap assembly to stretch to the required length.

Point 7 in FIG. 1 indicates a few of the many various eyebrow stencils that can be utilized for tracing or grooming.

Point 8 in FIG. 1 indicates the bottom right section of the template that can be utilized to groom an accurate and crisp beard design.

Point 9 in FIG. 1 indicates the lower section of the template that is designated to cut a straight front taper along the front top section of the head, more thoroughly described later on.

Point 10 indicates a zipper pull used to be held while adjusting the strap length and somewhat prevent the zipper lock from detaching from the strap assembly.

FIG. 1 shows the full invention which consists of the top, side and bottom sections of the template which can be used independently to focus on a specific look or used together to form a multitude of looks. The center of the template functions as a stencil primarily focused on shaping the eyebrows. The strap assembly is used to help mount the invention to the face so that the user has a more effortless experience in the grooming process. All of the features will be explained more in depth below with the additional figures.

Figure 2:
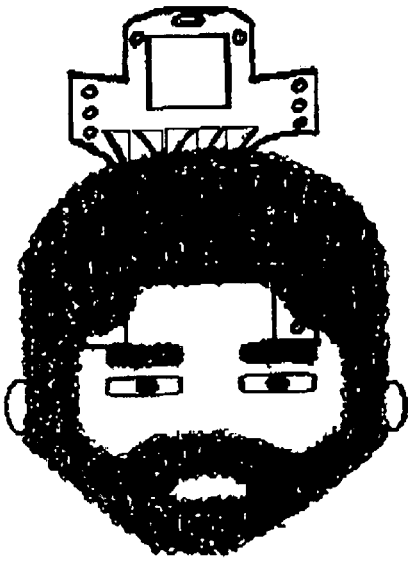
FIG. 2 shows the section of the invention that focuses on creating a straight and square front hairline.

FIG. 2 illustrates the bottom section of the template which is intended to be positioned over the top frontal section of the face. This focuses on assisting the user to primarily shape the frontal hairline to create straight and consistent square edge lines.

Figure 3:
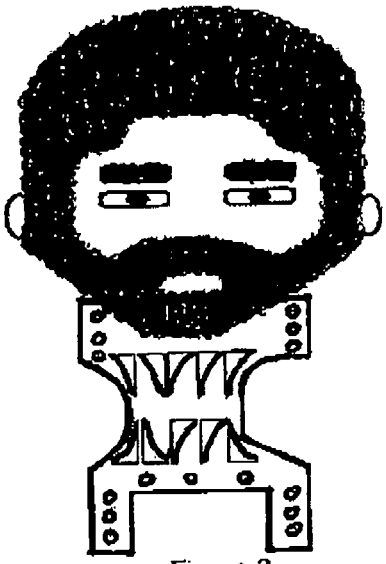
FIG. 3 shows a section of the invention that focuses primarily on shaping the mouth area of the user so that they can produce an optimal mustache and goatee design. This section also has a stop built in to help transition from the goatee to the beard effortlessly.

FIG. 3 illustrates the top section of the invention which is intended to be placed over the mouth. The purpose of this top section is for the invention to be superimposed over the mouth to help the user create an optimal mustache, goatee or bottom section of a beard design in addition to more unique looks around the mouth to the user's discretion. A section is cut out so that the lips do not impede with the template. The cut out section is large enough to allow most trimmers and clippers to fit within it to allow seamless grooming and shaping. The angles on each side, right under the mustache & goatee section at the top portion, serve as a stop to create a symmetrical transition angle on both sides of the mouth that will properly flow for a consistent full beard design. This is positioned to help the user create a straight line from the lower section of their goatee to the top lower beard area on both sides without having to remove or shift the template. This minimizes errors since the user will not have to move the template to create their desired look.

Figure 4:
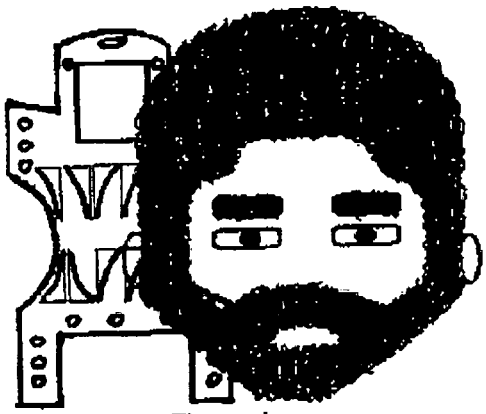
FIG. 4. & FIG. 5 show the section of the invention that focuses on shaping the sideburns and bottom section of the beard.
Figure 6:
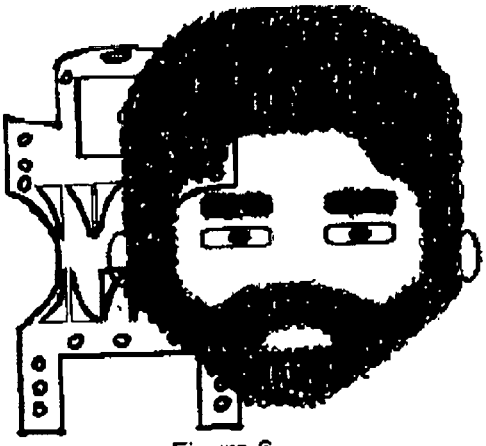
FIG. 6 shows the section of the invention that focuses primarily on shaping, filling in and drawing the desired eyebrow design.

FIGS. 4 & 6 illustrate how each side of the invention can be placed up against the sides of the face where the sideburns and upper beard are generally located. Both sides of the invention are primarily designated for shaping sideburns and helping to create a complete beard. One side is designed to be symmetrical regardless of which way it is flipped for the sideburns. The other side has two distinct curves that will create varying upper and lower sections of the sideburns, beard and top frontal side hairline sections. The sides of the template can also be used to shape the sections around the ear and towards the back side of the head.

Figure 5:
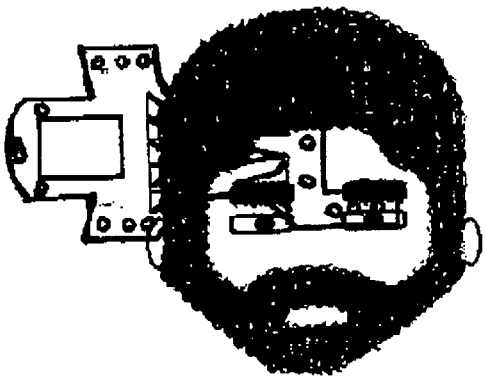

The interior of the invention is illustrated in FIG. 5 and is designated for modifying the eyebrows. Various shapes and eyebrow designs are placed on the template and can be used in combination with each other to create countless looks.

The top, side and bottom sections work in conjunction with each other to properly create the best connections that are crisp, consistent and clean. The use of various shapes and curves allow for a proper flowing hairline and beard design that transitions from one section of the face and flows into the rest effortlessly. This is most easily done by overlaying the bottom section of the template over the front of the hairline of the face and completing a straight and square design with two placements of the template.

Afterwards, use the side of the template that the user prefers the most and lay over each side of the face. Try choosing the same section and side orientation of the template for each side of the face to keep the facial look consistent. Finally, the top section is laid over the bottom of the face where the mouth is located and a proper goatee can be trimmed in order to complete a fully groomed beard. All of which can be completed in a minimum of 4-5 lifts of the template depending on the size and shape of the user's head and face.

Figure 7:
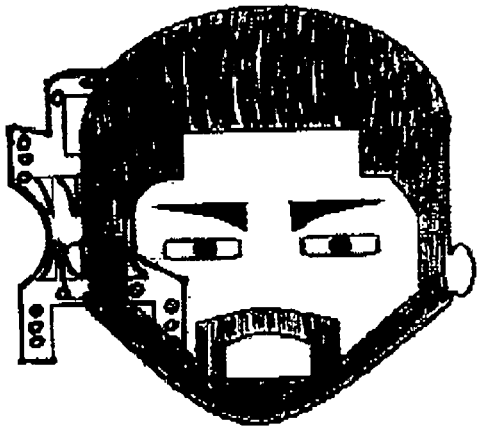
FIG. 7 shows a fully groomed customer accomplished using the template and stencil device positioned next to the face.

Once mastery of the template is achieved, the user can mix and match various sections of the template to create more unique designs from a multitude of combinations that fit their style the best as illustrated in FIG. 7.

The elastic strap assembly illustrated in FIG. 1 is made up of five individual off the shelf items: an elastic cord, a zipper pull, a plastic cord lock and two hooks. First, the cord is cut to length. A zipper pull is applied to the middle of the elastic cord by pulling the cord through it to prevent the plastic cord lock from falling off the elastic cord. The zipper pull also functions as an easy to grip handle used for loosening and tightening the elastic strap assembly to the face and head. The plastic cord lock is applied by pushing it down to engage it and sliding both ends of the elastic cord through it. This plastic cord lock serves as the mechanism the user will press to adjust the size of the strap so that it can be placed on anyone securely, safely and with ease. Afterwards, each end of the cord is strapped to a swivel clasp hook. The end of each cord is then looped around each hook and crimped or sewn to secure the hooks and ensure they cannot come loose. The purpose of the elastic strap assembly is to allow the user to adjust the length so that the template can be mounted to the user's face and head securely, comfortably and with ease. This elastic strap assembly is designed to be able to be attached and/or removed from the skits strategically placed in the invention depending on the orientation that the user decides to utilize. Whether it be to mount or affix the invention to the face or head to assist in maintaining how and where the invention is placed for consistent shaping or enable the user with hands free options to allow a cutting tool in one hand and mirror in the other. The features of this invention allow the user the freedom and flexibility to achieve their grooming and shaping goals.

I claim:

1. A multifunctional grooming template comprising:

a sheet of transparent, flexible plastic; and an adjustable strap(s), wherein the sheet has a plurality of contours configured to act as guides for cutting a user's hairline and facial hair, wherein the sheet has a plurality of eyebrow stencils configured to assist with filling in and shaping eyebrows, wherein the sheet has at least 5 holes arranged around an outer periphery of the sheet, wherein the strap(s) are configured to be removably attached to the holes, and wherein changing the holes that the strap(s) are attached to allows the sheet to be attached to the user's head in different orientations using the strap(s).

* * * * *